US006334961B1

(12) United States Patent
Wheatley et al.

(10) Patent No.: US 6,334,961 B1
(45) Date of Patent: Jan. 1, 2002

(54) LOW ASH GAS GENERANT AND IGNITION COMPOSITIONS FOR VEHICLE OCCUPANT PASSIVE RESTRAINT SYSTEMS

(75) Inventors: Brian K. Wheatley, Marshall; Norman H. Lundstrom, Manassas; Robert D. Lynch, Warrenton; R. Stephen Scheffee, Lorton; James D. Martin, Manassas, all of VA (US)

(73) Assignee: Atlantic Research Corporation, Gainesville, VA (US)

( * ) Notice: Subject to any disclaimer, the term of this patent is extended or adjusted under 35 U.S.C. 154(b) by 0 days.

(21) Appl. No.: 09/436,344

(22) Filed: Nov. 9, 1999

(51) Int. Cl.[7] ..... C06B 31/12; C06B 31/32; C06B 31/02; C06B 45/10

(52) U.S. Cl. ..... 252/186.44; 149/19.1; 149/19.5; 149/19.91; 149/62; 149/70; 149/72; 149/108.2

(58) Field of Search ..... 149/19.1, 19.5, 149/19.91, 62, 70, 71, 72, 78, 92, 108.2; 252/186.44

(56) References Cited

U.S. PATENT DOCUMENTS

| | | | | |
|---|---|---|---|---|
| 3,723,202 A | | 3/1973 | Butler et al. | |
| 4,853,051 A | | 8/1989 | Bennett et al. | 149/19.4 |
| 5,507,893 A | | 4/1996 | Mullay et al. | 149/76 |
| 5,531,941 A | | 7/1996 | Poole | 264/3.4 |
| 5,565,651 A | * | 10/1996 | Kim et al. | |
| 5,578,789 A | | 11/1996 | Oberth | 149/19.9 |
| 5,589,141 A | * | 12/1996 | Sides et al. | |
| 5,641,938 A | | 6/1997 | Holland et al. | 149/48 |
| 5,780,768 A | | 7/1998 | Knowlton et al. | 149/36 |
| 6,039,820 A | * | 3/2000 | Hinshaw et al. | |
| 6,156,137 A | * | 12/2000 | Lundstrom et al. | |

* cited by examiner

*Primary Examiner*—Joseph D. Anthony
(74) *Attorney, Agent, or Firm*—Nixon & Vanderhye P.C.

(57) ABSTRACT

Solid gas generant compositions produce low particulates (e.g., condensed ash) when ignited. The solid gas generant compositions most preferably include a nitramine, at least one oxidizer selected from nitrates of strontium or cerium, in admixture with or without potassium perchlorate, and a binder. Graphite may optionally be employed. The gas generant compositions are usefully employed in inflatable vehicle occupant passive restraint systems (e.g., air bag systems).

12 Claims, No Drawings

LOW ASH GAS GENERANT AND IGNITION COMPOSITIONS FOR VEHICLE OCCUPANT PASSIVE RESTRAINT SYSTEMS

FIELD OF THE INVENTION

The present invention relates generally to gas generant compositions, especially gas generant compositions employed in the inflation of vehicle occupant passive restraint systems.

BACKGROUND AND SUMMARY OF THE INVENTION

Various inflators for inflating vehicle occupant passive restraint systems (known colloquially in the art as "air bags") are known. Among the various types of inflators is one that utilizes a quantity of stored compressed gas which is selectively released to inflate the air bag. A related type of inflator generates a gas source from a combustible gas-generating material which, upon ignition, provides a quantity of gas sufficient to inflate the air bag. In still another type (known as a hybrid inflator), the air bag inflating gas is provided by the combination of a stored compressed gas and the combustion products of the gas generating material.

Inflators which depend entirely or partially on the generation of gases by virtue of combustion of combustible materials have several disadvantages. For example, the burning of the propellant and the initiator materials in such inflators results in the production or undesired particulate matter. Thus, using inflators that are particulate-containing or which generate particulates upon combustion as part of a passive restraint system in a vehicle might result in undesirable particulates being released into the occupant zone of the vehicles and thereby inhaled by the occupants. In particular, asthmatic reactions may be caused by inhalation of particulate matter, creating a health risk for the occupants. For this reason, automobile manufacturers limit the quantity and type of particulates released by the inflator system. Insoluble particulates are preferred over soluble particulates, as the latter are believed to cause greater reaction.

Particulates may arise from any energetic component, including gas generants and ignition systems, as well as through secondary combustion of inert inflator components. Reduction in the contribution of particulates from one or more of these components will generate a beneficial reduction in particulates for the whole inflator assembly.

One prior inflator is disclosed in commonly owned U.S. Pat. No. 5,589,141 to Sides et al (the entire content of which is expressly incorporated hereinto by reference). In the Sides et al '141 patent, the composition of the inflator comprises conducting ignition in the presence of an ammonium nitrate oxidizer and using a suitable propellant, e.g., aminoguanidine nitrate or a nitramine, such as cyclotrimethylenenitramine (RDX) and/or cyclotetramethylenetetranitramine (HMX), and in the presence of argon and a molecular oxygen-containing gas. The ratio of the oxygen-containing gas to argon is variably selected so as to provide only non-toxic reaction products in the exhaust gas.

Theory predicts that a successful ignition material for an inflator will give off hot particles or gases that will subsequently condense onto the cooler surface of the material being ignited and thereby transfer heat and produce "hot spots" which, in turn, lead to ignition. However, high levels of condensed species in the exhaust products of air bag inflators is undesirable due to respiratory effects on the automobile occupants s noted previously. Therefore a balanced ignition material is essential which contains minimal, but effective, levels of hot particles of condensed species. Furthermore, condensed species are preferred to be insoluble in water as these are considered to have less impact on occupants with respiratory ailments, such as asthma.

Broadly, the present invention is embodied in solid gas generant and ignition compositions which produce low particulates of the slightly-soluble or insoluble type when combusted. More specifically the present invention is embodied in solid gas generants and/or ignition compositions comprised of a nitramine, at least one oxidizer selected from the nitrate salts of strontium, copper, or cerium and/or complex nitrate salts of copper or cerium, in admixture with or without potassium perchlorate, and a binder. The gas generant and/or ignition compositions are usefully employed in inflatable passive vehicle occupant restraint systems (e.g., air bag systems). In contrast to many other igniter-booster formulations, these compositions burn readily at low temperature and pressure, and effectively ignite AN-based gas generants which are notoriously difficult to rapidly ignite under cold/low pressure conditions.

These and other aspects and advantages will become more clear from the following detailed description of the preferred exemplary embodiments thereof.

DETAILED DESCRIPTION OF THE PREFERRED EXEMPLARY EMBODIMENTS

The gas generant and igniter compositions of this invention necessarily include a nitramine fuel which contributes clean, particulate-free gas, and high flame temperatures to the composition. The preferred nitramines are those that contain a high percentage of oxygen. As will be discussed below, they enable the composition to be formulated with low amounts of the preferred oxidizers, the importance of which will be described in more detail below. The preferred nitramines burn readily at atmospheric pressures, an important attribute for ignition systems in inflator applications. Most preferably, the nitramine that is employed in the present invention is cyclotrimethylenetrinitramine (RDX) and/or cyclotetramethylenetetranitramine (HMX), but could also include CL-20, 2,4,6,8,10,12-hexanitro-2,4,6,8,10,12-hexaazaisowurtzitane (HNIW). The nitramine is employed in amounts between about 45 to about 90 wt. % and more preferably between about 45 to about 60 wt. % based on the total composition weight. The particle size of the nitramine affects the ballistic properties and compressive strength of pressed charges in the present invention. Fluid-energy-mill (FEM) ground nitramine produced higher compressive strength but did not burn as rapidly as coarser (i.e., Class I) particle sizes. In the present invention, the particle size of the selected nitramines will be tailored to meet the specific ballistic requirements of individual inflator designs.

The most preferred nitramine is HMX. In the present invention HMX was found to produce stronger pressed charges than RDX (tested under compression to the first stress-relief crack formed), and was found to have better stability under thermal cycling conditions (200 cycles over the temperature range of −40 to +107 C.). Further, in the present invention, HMX was found to provide lower pressure exponents over the pressure range of 1000 to 4000 psi which lead to more stable burning rates at high pressures in compressed charges (i.e, pellets or tablets). Typical properties are shown in Table B. This is an important attribute since ballistic reproducibility is linked closely to low pressure exponents and stable burning properties. RDX is less pure than HMX, is commercially easier to produce, and is obtained at lower cost, so the present invention may require use of RDX in part or in total to keep the cost of the invention low.

The gas generant and ignitor compositions of this invention will also necessarily include an oxidizer selected from at least one of the nitrate salts of strontium, copper, and/or cerium, or the complex nitrate salts of cerium and/or copper. These oxidizers, alone or in combination are the primary source of condensed species in the combustion process. These condensed species are typically one or more of the group which includes the parent metal, its oxides, hydroxides, and/or carbonates, all of which are of the desired form which is either slightly soluble or insoluble in water. Further, these oxidizers produce condensed particulates which plate-out or adhere readily to internal surfaces of the combustion chamber. This is an important attribute of the invention, as the particulates from these oxidizers tend to remain in the combustion chamber rather than exiting into the external environment of the inflator (i.e, automobile interior). For igniter applications, modest amounts of these condensed species are necessary to effect the desired sympathetic ignition of the primary gas generant. For gas generant applications, the lowest possible level of particulates in the combustion products are desired to satisy automotive requirements.

The oxidizer will be present in amounts between about 10 wt % to about 60 wt %, and most preferrably between about 25 wt % to about 45 wt. %. According to the present invention, the preferred oxidizer is a nitrate salt of strontium, copper, or cerium, including complex nitrate salts of either copper or cerium. Specific examples of complex salts of copper and cerium include copper-amine-nitrate complexes (e.g. $Cu(NH_3)_4NO_3)_2$), basic copper nitrate (e.g., $Cu(NO_3)_2.3[CL(OH)_2]$), cerium ammonium nitrate (e.g., $Ce(NH_4)_2(NO_3)_6$) and the like. Strontium nitrate and/or cerium ammonium nitrate are preferred. Potassium perchlorate (KP) may also be used either alone or in combination with the aforementioned oxidizers in order to modify the ballistics (burning rate and pressure exponent) of the invention, in which case the combined weight of KP and the other oxidizers remains in the range of 10 to 60 wt. %. Use of the preferred oxidizers in conjunction with the hot, clean nitramines described above provide a new class of clean-burning compositions suitable for use as either ignition material or as a gas generant.

The compositions of this invention may be used in the form of powders, granules, or compression-molded pellets and the like. The compositions are most preferably used in the form of a solid compression-molded mixture of the above components. It is important that the form of the invention have sufficient strength to withstand forces due to initiator shock or long term thermal aging and/or thermal cycling without loss of physical integrity. In this regard, the compositions will therefore most preferably include a highly oxygenated polymeric binder in an amount sufficient to bind the components into a more durable, stronger solid form (e.g., pellet).

Highly oxygenated binders are needed to achieve the low levels of solid combustion products required by new automotive specifications. Great emphasis is placed on airborne or suspended solids which may initiate asthmatic reactions, particularly in the water-soluble forms. Higher oxygen contents in the binder affects the quantity of solid ash produced by decreasing the amount of oxidizer required to maintain the necessary oxidizer:fuel ratio (O:F). O:F ratio is defined as the amount of oxygen present in the composition to the amount of oxygen required to fully combust all carbon and hydrogen to $CO_2$ and $H_2O$, and all other elements to their corresponding steady-state oxidized form. Balanced O:F ratios in the range of about 0.8 to 1.0 are needed to maintain non-toxic levels of CO and $NO_x$ in the combustion products. In the present invention, the oxidizer is the only major source of solid ash so that by minimizing oxidizer contents, the amount of solid ash is held to a minimum. For instance, the oxidizer strontium nitrate in the present invention yields strontium oxide, strontium hydroxide, and/or strontium carbonate solid ash. The ash is only slightly soluble or insoluble in water. In contrast, potassium perchlorate produces water-soluble potassium chloride as a combustion product. Both oxidizers yield effective ignition properties in the present invention, however only the strontium nitrate ash is of the preferred insoluble form. As the oxygen content of the binder is increased, the amount of oxidizer is reduced and thus the amount of solid ash is reduced.

In the application where the present invention is used as an ignition or booster for a secondary gas generant, the presence of moderate contents of hot, condensed (liquid or solid) combustion products are desired to obtain good ignition and flame spreading response in the secondary gas generant. This desired attribute is contrary to the goals of the automotive industry to limit solid combustion products in the combustion products for health reasons. The present invention combines highly oxygenated binders and nitramine fuels with the preferred oxidizers to enable both good ignition properties and non-toxic, acceptable levels of solid combustion products.

The binder will typically be present in an amount based upon the total composition weight, of between 1 and 15 percent, and preferably between about 3 and 7 percent. The preferred binders are highly oxygenated and include polymethylmethacrylate (PMMA with about 32 wt. % oxygen), polyvinyl alcohols (PVA with about 36 wt. % oxygen), and/or poly alkylene carbonates. Examples of polyalkylene carbonates that may be employed in this invention are those that are commercially available from PAC Polymers, Inc. as poly(propylene carbonate) copolymer (QPAC-40 with about 47 wt. % oxygen) and poly(ethylene carbonate) copolymer (QPAC-25 with about 54 wt. % oxygen).

The compositions of this invention may also include an ignition accelerator/augmentor in the form of a graphite powder. The preferred graphite powder has an average particle size of about 40 microns. One particularly preferred graphite powder is Microfyne Graphite commercially available from Joseph Dixon Crucible Company of Jersey City, N.J. When used, the graphite accelerator/augmentor is present in the compositions of this invention in an amount between about 0.1 wt.% to about 2.0 wt.%, and more preferably between about 0.25 wt.% to about 0.5 wt.%.

One particularly preferred composition in accordance with the present invention is as follows:

| Ingredient | Amt. (wt. %) |
|---|---|
| RDX | 60.0 |
| strontium nitrate | 38.0 |
| PVA binder | 1.0–2.0 |
| graphite powder | balance |

The present invention will be further understood from the following non-limiting Examples.

EXAMPLES

Example 1

A composition comprised of KP/RDX/QPAC/Graphite (30/66.25/3.5/0.25 was processed by pre-dispersing the binder in methylene chloride (MeCl), coating the RDX with the binder/MeCl solution, adding the KP, and then removing the solvent under agitation to yield small beaded agglomerates of the mixture. Properties of the mixture are shown in Table A, below.

Example 2

Example 1 was repeated except that the amount of the QPAC binder was increased to 7.0 wt.%, while the amount of RDX was decreased to 62.75 wt.%. Properties of the mixture are shown in Table A below.

Example 3

A mixture of SrN/RDX/QPAC/Graphite (30/66.25/3.5/0.25) was processed as in Example 1 above. Properties of the mixture are shown in Table A below.

Example 4

A mixture of SrN//KP/RDX/QPAC/Graphite (15/15/66.25/3.5/0.25) was processed as in Example 1 above. Properties of the mixture are shown in Table A below.

Example 5

A mixture of strontium nitrate/RDX/PVA/Graphite (45/50/5/0.5) was processed in an aqueous slurry by first dissolving the PVA and strontium nitrate in hot water, and then slurrying in the RDX powder (nominal particle size of 20 micron) until the RDX is fully wetted, and then removing the water by convection oven followed by vacuum oven drying. The resultant dry cake was broken up and then ground to a size which will pass a 30 mesh screen but which will not pass a 100 mesh screen (−30/+100). Graphite was added to ground material in a dry mixture, and then compression molded pellets for test purposes. Properties of the mixture are shown in Table A below.

Example 6

A mixture of strontium nitrate/HMX/PVA/Graphite (45/50/5/0.5) was processed in a manner similar to that used in Example 5. Properties of the mixture are shown in Table A below. Notably, the pressure exponent values of this and other mixtures using HMX were lower than those typified by Example 5.

Example 7

A mixture of strontium nitrate/RDX/PVA/Graphite (38/60/2/0.25) was processed in a manner similar to that used in Example 5. Approximately ½" diameter pellets were compression molded at 50,000 psi to provide samples for pellet crush strength and for cycling and aging tests. The results of these tests are detailed in Table B. Notably, the samples cycled over the temperature range of −40 to +107° C. showed dimensional changes and loss of pellet strength after 200 cycles.

Example 8

A mixture of strontium nitrate/HMX/PVA/Graphite (38/60/2/0.25) was processed in a manner similar to that used in Examples 5 and 7. Approximately ½" diameter pellets were compression molded at 50,000 psi to provide samples for pellet crush strength and for cycling and aging tests. The results of these tests are detailed in Table B. Unlike the results for Example 7, these pellets had good stability throughout the 200 cycles. The initial pellet strength values were also higher.

TABLE A

| | Ex. 1 | Ex. 2 | Ex. 3 | Ex. 4 | Ex. 5 | Ex. 6 |
|---|---|---|---|---|---|---|
| Ingredients: | | | | | — | |
| KP | 30 | 30 | — | 15 | 45 | — |
| SrN | — | — | 30 | 15 | 50 | 45 |
| RDX | 66.25 | 62.75 | 66.25 | 66.25 | — | — |
| HMX | — | — | — | — | — | 50 |
| QPAC-40 | 3.5 | 7.0 | 3.5 | 3.5 | 5 | — |
| PVA | — | — | — | — | 0.5 | 5 |
| Graphite | 0.25 | 0.25 | 0.25 | 0.25 | | 0.5 |
| Thermochemical | | | | | | |
| Properties: | 0.9 | 0.83 | 0.86 | 0.87 | 0.94 | 0.94 |
| O:F Ratio | 3411 | 3225 | 3243 | 3203 | 3024 | 3020 |
| Flame Temp., ° K. | 16.1 | 16.1 | 14.7 | 15.4 | 22.0 | 22.0 |
| Condensed Ash, wt. % | KCl, sol. | KCl, sol. | SrO, insol. | KCl, sol. SrO, insol. | SrO, insol. | SrO, insol |
| Condensed products(1) & Approx. solubility in $H_2O$ | | | | | | |

(1)Note: predominant compound/element predicted

TABLE B

| Nitramine Type | Ex. 7 RDX | Ex. 8 HMX |
|---|---|---|
| Pellet Strength Data, dia., in./psi to crush: | | |
| Baseline | .522/3202 | .522/4896 |
| 17 day aging at 107 C | .522/3392 | .522/4538 |
| 200 cycles (−40 to +107 C) | .543/1804 | .523/4176 |

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A solid gas generant composition comprised of:

(1) between about 50 wt. % to about 90 wt. %, based on total composition weight, of at least one nitramine selected from the group consisting of cyclotrimethylenetrinitramine, cyclotetramethylenetetranitramine, and 2,4,6,8,10,12-hexanitro-2,4,6,8,10,12-hexaazaisowurtzitane, (2) a binder which is at least one selected from the group consisting of polyvinyl alcohols and poly(alkylene) carbonate, (3) an oxidizer which includes strontium nitrate, and (4) optionally, graphite.

2. The gas generant composition of claim 1, wherein the oxidizer is a mixture of strontium nitrate and potassium perchlorate.

3. The gas generant composition of claims 1 or 2, wherein the oxidizer is present in an amount, based on total composition weight, of between about 10 wt. % to about 50 wt. %.

4. The composition of claim 1, wherein the binder is present in an amount, based on total composition weight, of between about 1 wt. % to about 15 wt. %.

5. The composition of claim 1, further comprising a graphite powder in an amount, based on total composition weight, of between about 0.1 wt. % to about 2.0 wt. %.

6. A gas-generant composition as in claim 1, which comprises, based on total composition weight, of between about 50 to about 90 wt. % of said nitramine, between about 10 to about 50 wt. % of strontium nitrate as an oxidizer, and between about 1 to about 15 wt. % of a polyvinyl alcohol or poly(alkylene) carbonate binder.

7. The gas generant composition of claim 6, which further comprises potassium perchlorate in an amount such that the combined weight of said strontium nitrate and potassium perchlorate is between about 10 to about 50 wt. %.

8. The gas-generant composition of claim 6, which comprises between about 60 to about 50 wt. % of cyclotrimethylenetrinitramine.

9. The gas-generant composition of claim 6 or 8, which comprises between about 10 to about 35 wt. % of strontium nitrate.

10. The gas generant composition of claim 9, which further comprises graphite in an amount between about 0.1 to about 2.0 wt. %.

11. The gas generant composition of claim 10, wherein graphite is present in an amount between about 0.25 to about 0.5 wt. %.

12. A solid gas generant composition comprising, based on total composition weight, about 60 wt. % of cyclotrimethylenetrinitramine, about 38 wt. % of strontium nitrate, between about 1–2 wt. % of polyvinyl alcohol and balance, a graphite powder.

* * * * *